US006125966A

United States Patent [19]

Jones

[11] Patent Number: 6,125,966

[45] Date of Patent: Oct. 3, 2000

[54] HARNESS ASSEMBLY FOR SAFELY RESTRAINING A PERSON IN ELEVATED POSITION PROXIMATE A VERTICAL OBJECT

[76] Inventor: Dennis Keith Jones, 195 Loann La., Huntsville, Ala. 35811

[21] Appl. No.: 08/714,289

[22] Filed: Sep. 18, 1996

Related U.S. Application Data

[63] Continuation-in-part of application No. 08/418,192, Apr. 7, 1995, abandoned.

[51] Int. Cl.[7] ..... A62B 35/00

[52] U.S. Cl. ..... 182/3; 182/6

[58] Field of Search ..... 182/3, 6

[56] References Cited

U.S. PATENT DOCUMENTS

| | | | |
|---|---|---|---|
| 284,434 | 9/1883 | Keech | 182/7 |
| 2,647,293 | 8/1953 | Wintercorn | 182/4 |
| 2,725,204 | 11/1955 | Horning | 244/151 R |
| 4,273,215 | 6/1981 | Leggett | 182/3 |
| 4,687,074 | 8/1987 | Green | 182/3 |
| 5,080,191 | 1/1992 | Sanchez | 182/3 |
| 5,360,087 | 11/1994 | Bell | 182/6 |
| 5,378,046 | 1/1995 | Gordy | 182/3 Y |
| 5,433,289 | 7/1995 | O'Rourke | 182/6 X |
| 5,487,444 | 1/1996 | Dennington | 182/6 |
| 5,531,292 | 7/1996 | Bell | 182/6 |

FOREIGN PATENT DOCUMENTS

| | | | |
|---|---|---|---|
| 271254 | of 0000 | Switzerland | 182/3 |

*Primary Examiner*—Alvin Chin-Shue
*Attorney, Agent, or Firm*—Gardner & Groff, P.C.

[57] ABSTRACT

A safety restraint device, such as may be worn by a hunter or wildlife photographer perched on a tree stand for preventing falls, comprising a waist belt which incorporates a quick release buckle, a shoulder harness including front and rear straps with each front strap incorporating a quick release buckle, a pair of thigh straps, each of which incorporates a quick release buckle, a front cross strap for connecting the front straps of the shoulder harness and incorporating a quick release buckle therein, a rear cross strap, a lanyard having one of its end portions slidably secured to the rear cross strap and having a free end, a tree strap for attachment to the free end of the lanyard, a connector for releasably closing and securing the tree strap to a tree or other fixed object, and a pouch or pocket for orderly storing the shoulder harness, front cross strap, rear cross strap, lanyard and tree strap and possibly the thigh straps and waist belt. The safety restraint device of the present invention can be easily donned by a user even in the wilderness during darkness associated with the nighttime.

13 Claims, 7 Drawing Sheets

HARNESS ASSEMBLY FOR SAFELY RESTRAINING A PERSON IN ELEVATED POSITION PROXIMATE A VERTICAL OBJECT

This application is a continuation-in-part of application Ser. No. 08/418,192, filed Apr. 7, 1995, now abandoned.

TECHNICAL FIELD

This invention relates to harness assemblies, and more particularly to harness assemblies used by hunters, wildlife photographers, and others to prevent accidental falls to the ground when using a tree stand.

BACKGROUND OF THE INVENTION

Tree stands which allow hunters, wildlife photographers, and others to climb trees and remain perched thereupon have become increasingly popular in recent years. While most tree stands are generally safe, injuries from falls frequently occur to persons utilizing tree stands mounted to tree trunks.

Persons using tree stands have been extremely uncomfortable when standing on tree stands due to apprehensions of heights and the possibility of falling from the stand. Because of these apprehensions, a person may not feel free to move and turn on the stand to take proper aim and, accordingly may not be able to take proper aim to make the best shot, either through use of a gun or camera, at the wildlife within their view.

To minimize the possibility of accidentally falling to the ground from tree stands, it has been common practice to utilize ropes, straps and other devices to ensure that the person on the stand does not fall to the ground and cause injury to the person. Most prior art devices do not allow a user to feel comfortable to move and turn on a tree stand while restrained by the devices.

Prior art devices known to exist include those disclosed and claimed in the following U.S. Pat. Nos.: 4,273,215; 4,396,091; 4,478,311; 4,579,196; 4,923,048; 4,951,778; 4,991,689; 5,050,704; 5,203,829; and 5,341,896. Of these prior art devices, those disclosed in U.S. Pat. Nos. 4,273,215; 4,991,689; 5,050,704; and 5,203,829 appear to be somewhat pertinent to the improved safety restraint device of the present invention.

U.S. Pat. No. 4,273,215 discloses a harness assemblies comprising a chest web which surrounds the user's chest, a waist web which partially engages the user's waist, a shoulder web which extends over the user's shoulders, a rear gang connector which connects each of the chest web, the waist web and shoulder web at the center of the user's back, a lifeline web fixedly secured to the rear gang connector, quick release buckles for connecting the free ends of the waist and chest webs, and an object engaging web secured to the free end of the lifeline web.

U.S. Pat. No. 4,991,689 (FIG. 5) discloses a harness assemblies comprising a body harness which partially surrounds the user's shoulders, chest, back and thighs and having a D-ring member adjacent the back of the user; and a lanyard having a snap hook at one of its ends for engaging the D-ring member and loop means at its other end for engaging a fixed object.

U.S. Pat. No. 5,050,704 (FIGS. 3 and 4) discloses a harness assembly comprising two shoulder straps crossing at the user's back and including a pair of leg straps; a support plate for surrounding the shoulder straps where they cross at the user's back; a cross strap for connecting the shoulder strap adjacent the user's chest and having a releasable buckle therein; and a safety line adapted for connection at one of its ends to the support plate and at its other end to a fixed object such as a pole.

U.S. Pat. No. 5,203,829 (FIGS. 1–6) discloses a safety harness comprising a shoulder strap for surrounding the shoulders of a user; a waist strap that partially surrounds the waist of a user; a seat strap including end portions for wrapping around the user's thighs; a rear lanyard mounting ring; and a plurality of buckles for releasably securing the ends of the straps to fasten the harness to the user.

Each of these prior art harness assemblies include numerous deficiencies and disadvantages which are overcome by the safety restraint device of the present invention.

The present invention provides an improved safety restraint device that fills a need for a simple, effective, easy to use, device which is not hampered by flexibility of movement of the user and which includes a pouch or pocket for housing a major portion of the device when the user is not wearing the device which permits storage of the device in an orderly and untangled condition so that the user can easily and readily don the device in the wilderness even during the darkness of early morning.

SUMMARY OF THE INVENTION

The safety harness assembly and restraint device disclosed herein is of extremely simple construction and of a highly effective design that can be easily and readily donned by a user even in the wilderness during darkness associated with the nighttime. The safety harness assembly and generally includes a waist belt which incorporates a quick release buckle, a shoulder harness including front and rear straps with each front strap incorporating a quick release buckle, a pair of thigh straps, each of which incorporates a quick release buckle, a front cross strap for connecting the front straps of the shoulder harness and incorporating a quick release buckle therein, a rear cross strap, a lanyard having one of its end portions secured to the rear cross strap and having a free end, a tree strap for attachment to the free end of the lanyard, a connector for releasably closing and securing the tree strap to a tree or other fixed object, and a pouch or pocket for orderly storing the shoulder harness, front cross strap, rear cross strap, lanyard and tree strap and possibly the thigh straps and waist belt.

The safety harness assembly and restraint device of the present invention is constructed such that due to the location of the rear cross strap and the attachment of the lanyard thereto, a person may wear the device under clothing. The safety harness assembly and restraint device is further constructed such that the shoulder harness, front cross strap, rear cross strap, lanyard and tree strap and possibly the thigh straps and waist belt can be orderly stored in the pouch or pocket when not in use and can be readily placed upon the user even during the nighttime without having to worry about untangling the several parts.

Four quick release buckles are required for donning and removing the safety harness assembly of the present invention. As explained hereinabove, one buckle is part of the waist belt, two buckles are part of the thigh straps, and one buckle is a part of the front cross strap of the shoulder harness. The two quick release buckles in the front straps of the shoulder harness remain buckled when stored in the pouch and when a user dons and removes the safety restraint device of the present invention. Each of the quick release buckles incorporated in the waist belt and the front cross strap include male and female portions which are easy to use yet secure when fasten. Each of the quick release buckles incorporated in the front straps of the shoulder harness and the thigh straps are pass through buckles which allow the free end of a strap to pass through two openings in the buckle to clamp the strap between a movable member and a stationary member of the buckle.

It is an object of this invention to provide a safety harness assembly and restraint device that is easy to don even in the darkness of the night, comfortable to wear, capable of being worn under clothing, and relatively inexpensively manufactured.

It is a further object of this invention to provide a safety harness assembly and restraint device for outdoor users that can be easily donned by the user, comfortable to wear, relatively inexpensively manufactured, and capable of being housed in an orderly fashion both before and after use.

It is a still further object of this invention to provide a safety harness assembly and restraint device for an outdoorperson that is easily and orderly packaged in a pouch or pocket forming a part of the device that permits the outdoorperson to easily don the device even in the darkness of the night.

Other objects and advantages of the invention will become apparent from the following detailed description and from the appended drawings in which like numbers have been used to described like parts throughout the several views.

DESCRIPTION OF THE PREFERRED EMBODIMENT

Figure 1:
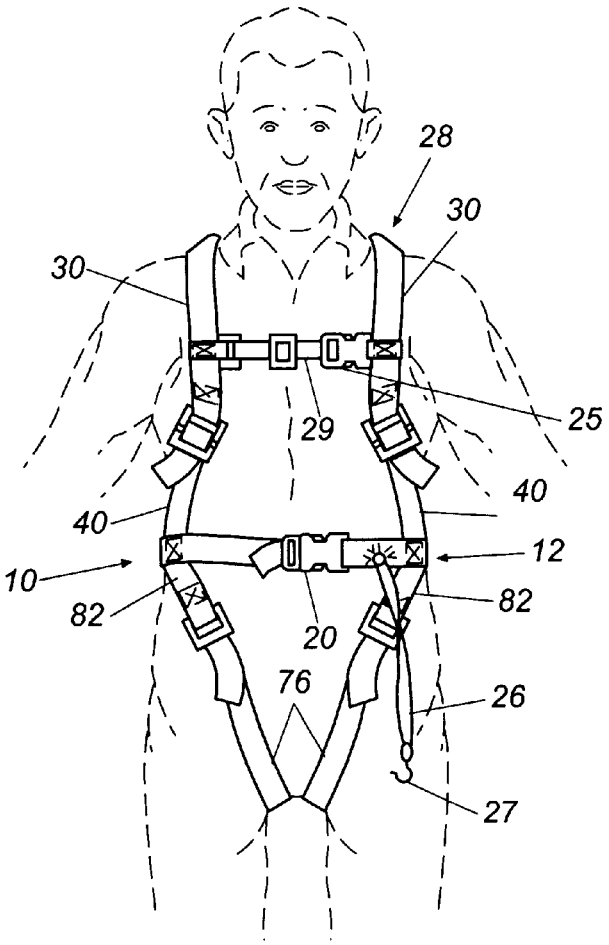
FIG. 1 is a front elevational view of the safety restraint harness of the present invention as worn by a person.

Referring to the drawings, reference numeral 10 generally designates the preferred embodiment of the safety harness assembly of the present invention. Safety restraint device 10 generally comprises a waist belt 12, a shoulder harness 28, thigh straps 74, a lanyard 68, a tree strap 90, and a pouch or pocket 102 for housing the shoulder harness 28, the lanyard 68 and tree strap 90 and possibly the waist belt 12 and thigh straps 74 when the safety harness assembly 10 is not being worn by the user. The safety harness assembly 10 can be worn with shoulder harness 28, the lanyard 68, and tree strap 90 remaining in pouch 102 when not in use in association with a fixed object such as a tree 108.

Figure 4:
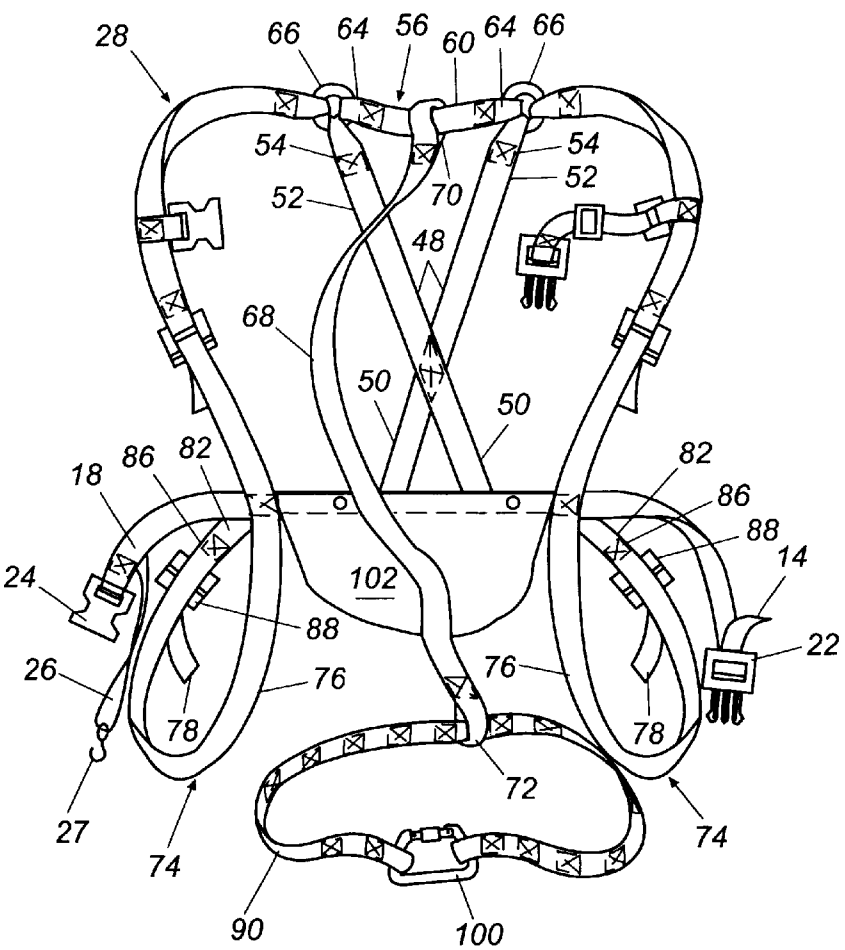
FIG. 4 is a rear elevational view of a partially disassembled safety restraint harness of the present invention.
Figure 3:
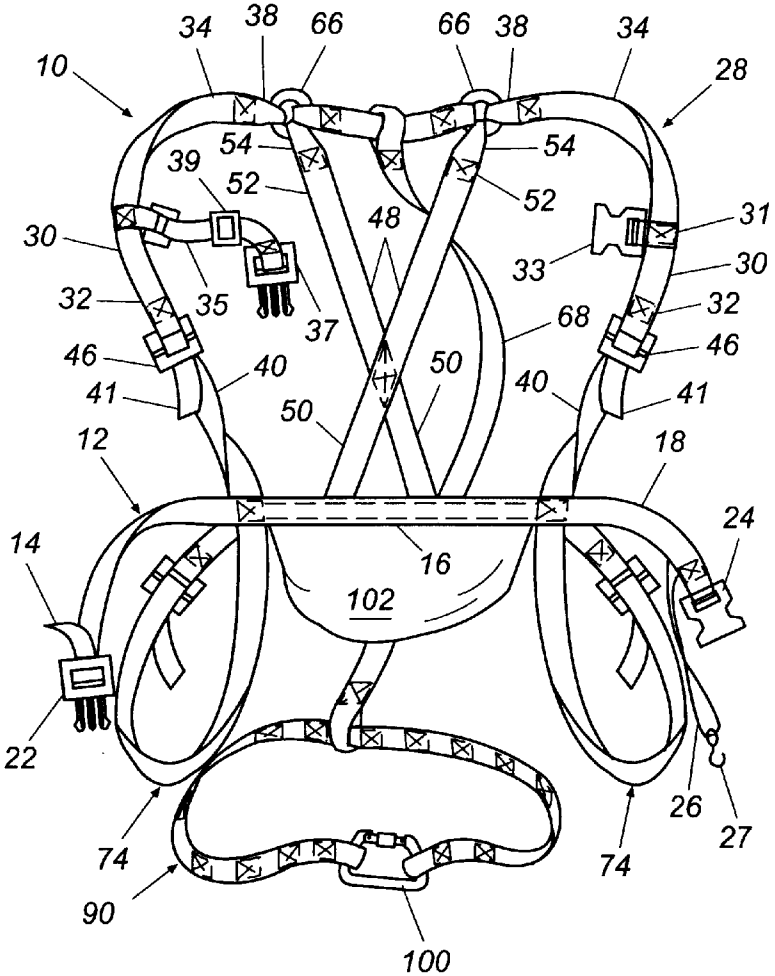
FIG. 3 is a front elevational view of a partially disassembled safety harness assembly and restraint harness of the present invention.
Figure 5:
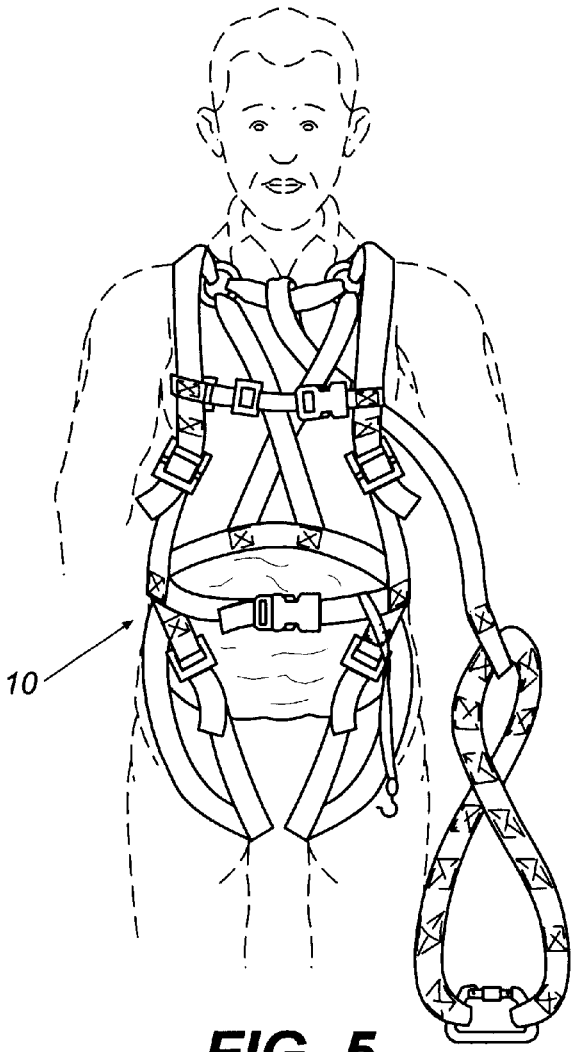
FIG. 5 is a perspective view of the safety harness assembly and restraint harness of the present invention as worn by a person.
Figure 6:
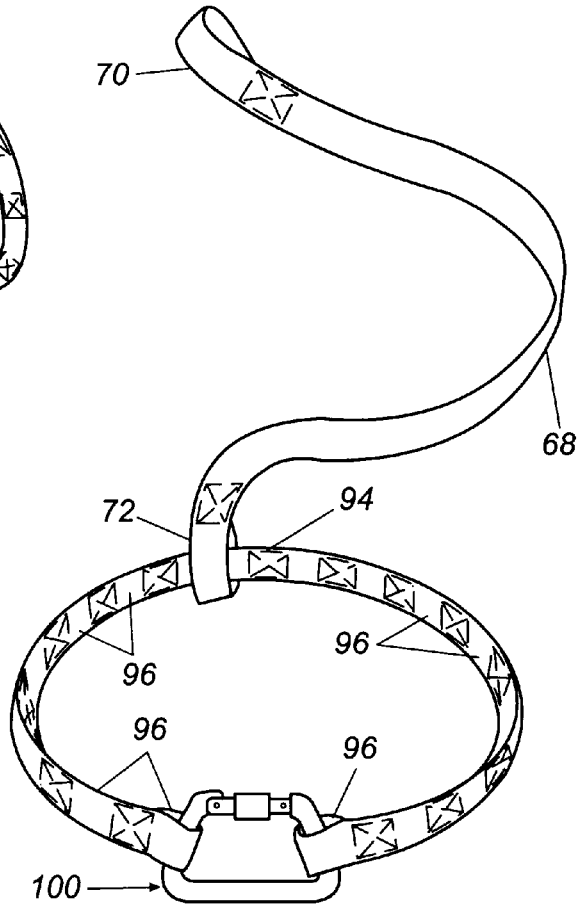
FIG. 6 is a front elevational view showing the details of the lanyard and the tree strap.
Figure 7:
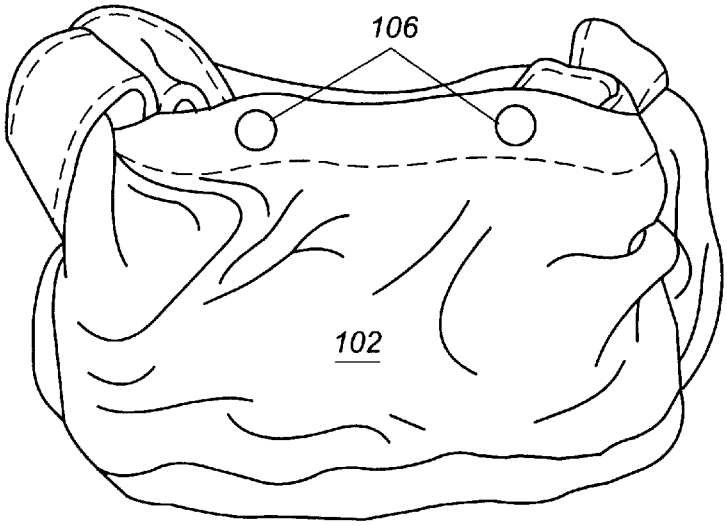
FIG. 7 is a rear elevational view of the safety harness assembly and restraint harness of the present invention packed in the storage pouch.

Now referring to FIGS. 1, 3 and 4, waist belt 12 comprises a first end section 14, an intermediate section 16, a second end section 18, and a quick release buckle 20. Quick release buckle 20 includes a male connector member 22 adjustably secured to first end section 14 of waist belt 12 and a hollow female connector member 24 secured to second end section 18 of waist belt 12 by any suitable means such as cross stitching. Female connector member 24 includes a generally rectangular opening (unnumbered) for receiving male connector member 22 of quick release buckle 20. Buckles such as quick release buckle 20 are readily available in the commercial market and may be similar to the Fastex SR-2 manufactured by ITW NEXUS, Wood Dale, Ill., Part No. 101-1225 manufactured by ITW Waterbury, Waterbury, Conn., or those disclosed in U.S. Pat. Nos. 4,150,464 and 4,171,555.

Still referring to FIGS. 1, 3 and 4, shoulder harness 28 comprises a pair of front main straps 30, each including a first end portion 32, a second end portion 34, a buckle 46 secured by any suitable means such as cross stitching to first end portion 32 of each front main straps 30 and a loop or opening 38 formed in second end portion 34 by cross stitching, a pair of short front straps 40, each having a first end portion (unnumbered) secured to respective end sections 14 and 18 of waist belt 12 by any suitable means such as cross stitching and a second end portion 41, which passes through a respective buckle 46. Buckles such as quick release buckles 46 are readily available in the commercial market and may be similar to Parts Nos. MS7010-1, 2, 3 manufactured by United States Forgecraft Corporation, Fort Smith, Ark. As best shown in FIGS. 1 and 3, shoulder harness 28 further comprises a front cross strap 29 including a quick release buckle 25, a first strap 31 secured on a front main strap 30 by any suitable means such as cross stitching, a second strap 35 secured on the other of front main straps 30 by any suitable means such as cross stitching. The quick release buckle 25 includes a hollow female member 33 secured to first strap 31 by the first strap 31 passing through an opening (unnumbered) in female member 33, a male member 37 secured to the free end of second strap 35 by the second strap 35 passing through an opening (unnumbered) in male member 37 and by cross stitching. A conventional adjustment device 39 is provided in first strap 35 for adjusting the length of front cross strap 29. Quick release buckle 25 is readily available in the commercial market and may be similar to Parts Nos. 123-0075 and 123-0100 manufactured by ITW Waterbury, Waterbury, Conn. or those disclosed in U.S. Pat. Nos. 4,150,464 and 4,171,555. Shoulder harness 28 further comprises a pair of rear main, shoulder, straps 48, each having a first end portion 50 secured by any suitable means such as cross stitching to the intermediate section 16 of waist belt 12 and a second end portion 52 having a loop or opening 54 therein formed by any suitable means such as cross stitching. Shoulder harness 28 further comprises an elongated rear cross strap 56 including end sections (unnumbered), an intermediate section 60, and a loop or opening 64 formed by any suitable means such as cross stitching in each end section of rear cross strap 56, and a pair of O-rings 66 which pass through respective loops or openings 38 in second end portions 34 of front main straps 30, loops or openings 54 in rear main straps 48, and loops or openings 64 in rear cross strap 56 to connect first main straps 30, rear main straps 48, and rear cross strap 56. O-rings such as O-rings 66 are readily available in the commercial market and may be similar to Part No. 5010 manufactured by United States Forgecraft Corporation, Fort Smith, Ark.

As best seen in FIGS. 3 and 4, safety harness assembly 10 still further comprises a pair of thigh straps 74, each including a rear thigh strap 76, each having a first end portion (unnumbered) secured to intermediate section 16 of waist belt 12 by any suitable means such as cross stitching, and a second or free end portion 78; and a pair of front thigh straps 82, each having a first end portion (unnumbered) secured to respective end sections 14 and 18 of waist belt 12 by any suitable means such as cross stitching, and a second end portion 86 having a quick release buckle 88 secured thereto by any suitable means such as a loop and cross stitching. Each quick release buckle 88 has two openings (unnumbered) therein for receiving a respective end portion 78 of rear thigh straps 76, which buckles 88 are readily available in the commercial market and may be similar to Parts Nos. MS701O1-1, 2, 3 manufactured by United States Forgecraft Corporation, Fort Smith, Ark.

Figure 2:
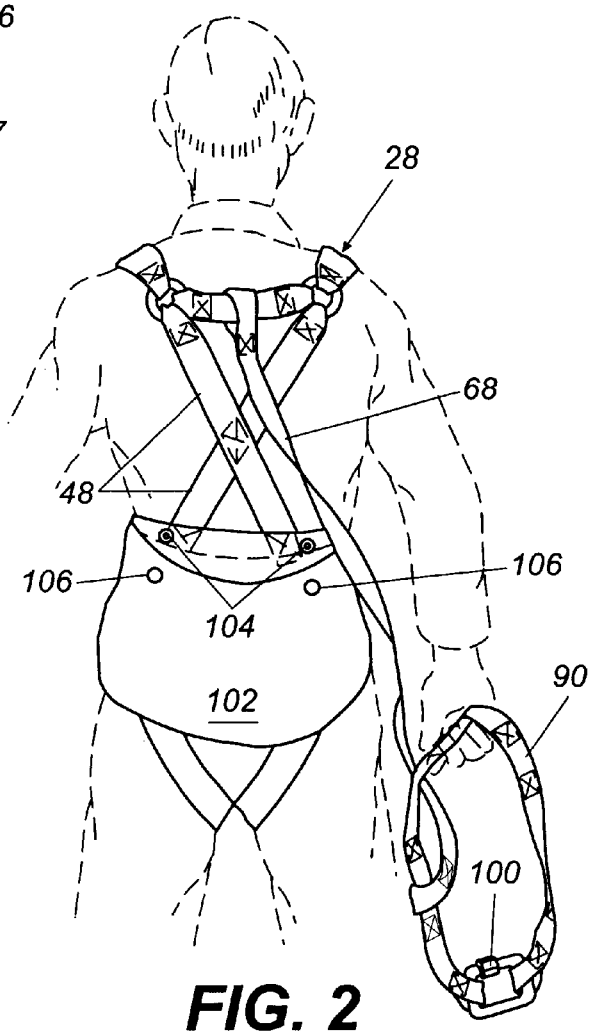
FIG. 2 is a rear elevational view of the safety harness assembly and restraint harness of the present invention as worn by a person.

Safety harness assembly 10 still further comprises a pouch or pocket 102 secured to the intermediate section 16 of waist belt 12 by any suitable means such as stitching, cross stitching or rivets, and cooperating male fasteners 104 (FIG. 2) and female fasteners 106 (FIG. 2) for closing pouch or pocket 102. Male and female fasteners 104 and 106 snap together for a friction fit. The male and female fasteners 104 and 106 are readily available in the commercial market and may be similar to fasteners made from selected Parts Nos. X2-10127, X2-10128, XB-10224, XX-10224, BS-10412, BS-10413, BS-10414, and BS-10370 manufactured by United Textile And Supply Company, with offices at Los Angeles, Calif., Central Falls, R.I., Arlington, Tex. and Fort Lauderdale, Fla.

As best seen in FIGS. 2–4, 6 and 8, a restraint device 67 is provided for use with the safety harness assembly 10. Restraint device 67 comprises an elongated lanyard or strap 68 and a tree strap 90. Lanyard 68 has a first closed loop or opening 79 formed by any suitable means such as cross stitching in one of its ends for slidably receiving intermediate section 60 of rear cross strap 56 of harness assembly 10 and a second loop or opening 72 formed by any suitable means such as cross stitching in its other end for purposes to be explained hereinbelow.

Figure 8:
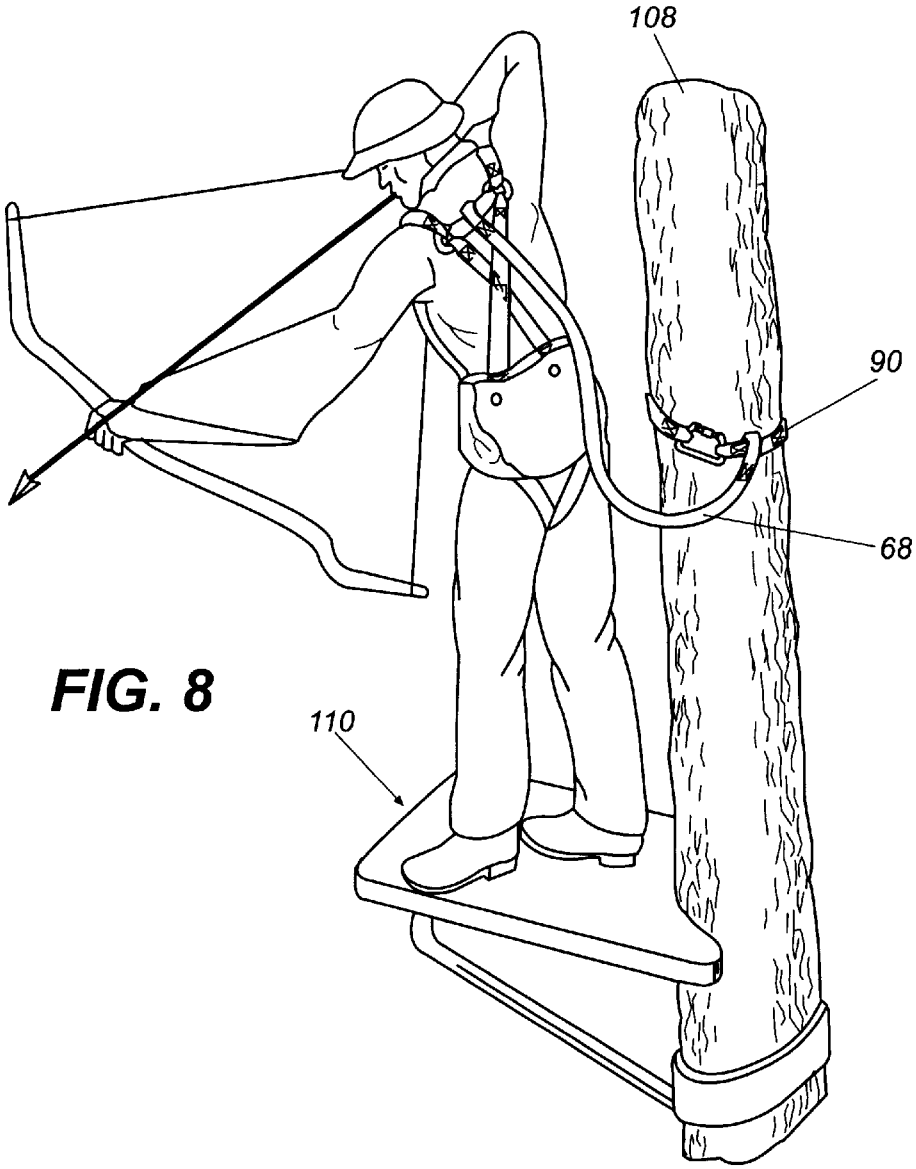
FIG. 8 is a diagrammatic view of the safety harness assembly and restraint harness of the present invention as worn by a person used in conjunction with a hunter's tree stand.

Tree strap 90 has two end sections (unnumbered), an intermediate section 94, a plurality of spaced openings or loops 96 formed by any suitable means such as spaced cross stitching, and a releasable connector 100 fixed to one end of the tree strap 90. Connector 100 is adapted for passing through a selected spaced opening or loop 96 in strap 90 to secure tree strap 90 to a tree or fixed object 108 (FIG. 8). Releasable connector 100 is readily available in the commercial market and may be similar to the 11 mm D Locking Screw Gate Carabiner manufactured by Blue Water, Carrollton, Ga.

Now referring to FIG. 8, reference numeral 108 refers to a tree or other fixed object having a conventional tree stand 110 secured thereto. FIG. 8 further depicts a hunter wearing the safety restraint device 10 of the present invention, but without a jacket on, standing on the conventional tree stand 110 aiming his bow and arrow and being tethered to tree or other fixed object 108 by lanyard 68 and tree strap 90.

A bow holder cord 26 is secured at one of its ends to the second end section 18 of waist belt 12 by any suitable means such as cross stitching and has a hook 27 at its free end for holding or supporting a bow, camera or the like, at times when the person perched on the tree stand 110 is not observing wildlife.

The following describes the preferred manner for a person to place the safety harness assembly 10 upon his person and to secure safety restraint device 67 to a fixed object such as tree 108 to prevent the person from accidentally falling to the ground and injuring himself:

a. prior to entering the wilderness (woods) the person unbuckles the quick release buckle 20, places the waist belt 12 about his waist, secures the buckle 20 about his waist, and pulls on the free end 14 of waist belt 12 to tighten waist belt 12;

b. the person will then rotate the waist belt 12 until the pouch 102 is in front of the person;

c. the person then removes the shoulder harness 28, the lanyard 68, and the tree strap 90 from pouch 102;

d. the person then rotates waist belt 12 about his waist until buckle 20 is in the front of the person and pouch 102 is in the back of the person;

e. the person then engages the free ends 78 of respective rear thigh straps 76 and threads same through the openings in respective quick release buckles 88 and by pulling on free ends 78 of each rear thigh strap 76 tightens the thigh straps 78 about the thighs of the wearer;

f. the person then pulls on shoulder harness 28 to place shoulder harness 28 about his shoulders (like putting on a jacket);

g. the person then pulls on the free ends 41 of each short front strap 40 to tighten shoulder harness 28 about his shoulders;

h. the person then buckles quick release buckle 25 and tightens front cross strap 29 by moving the adjustment device 39;

i. the person then climbs up to stand upon tree stand 110 mounted to tree or fixed object 108;

j. the person then threads tree strap 90 through loop 72 of lanyard 68 if such has not been previously accomplished;

k. the person then wraps trees strap 90 about the trunk of tree or other fixed object 108 and engages connector 100 through a selected opening 96 at a location such that tree strap 90 is relatively tight about the trunk of tree or other fixed object 108.

Each of the belt 12, shoulder harness 28, thigh straps 74, lanyard 68 and tree strap 90 can be made of any suitable material including webbings of various sizes made of cotton, nylon, polypropylene, or polyester, which materials, preferably of camouflage colors, are commercially available from Elizabeth Webbing Mills Company, Inc., Pawtucket, R.I. The pouch or pocket 102 is preferably made of a suitable material such as cotton or nylon of a camouflage color.

Figure 9:
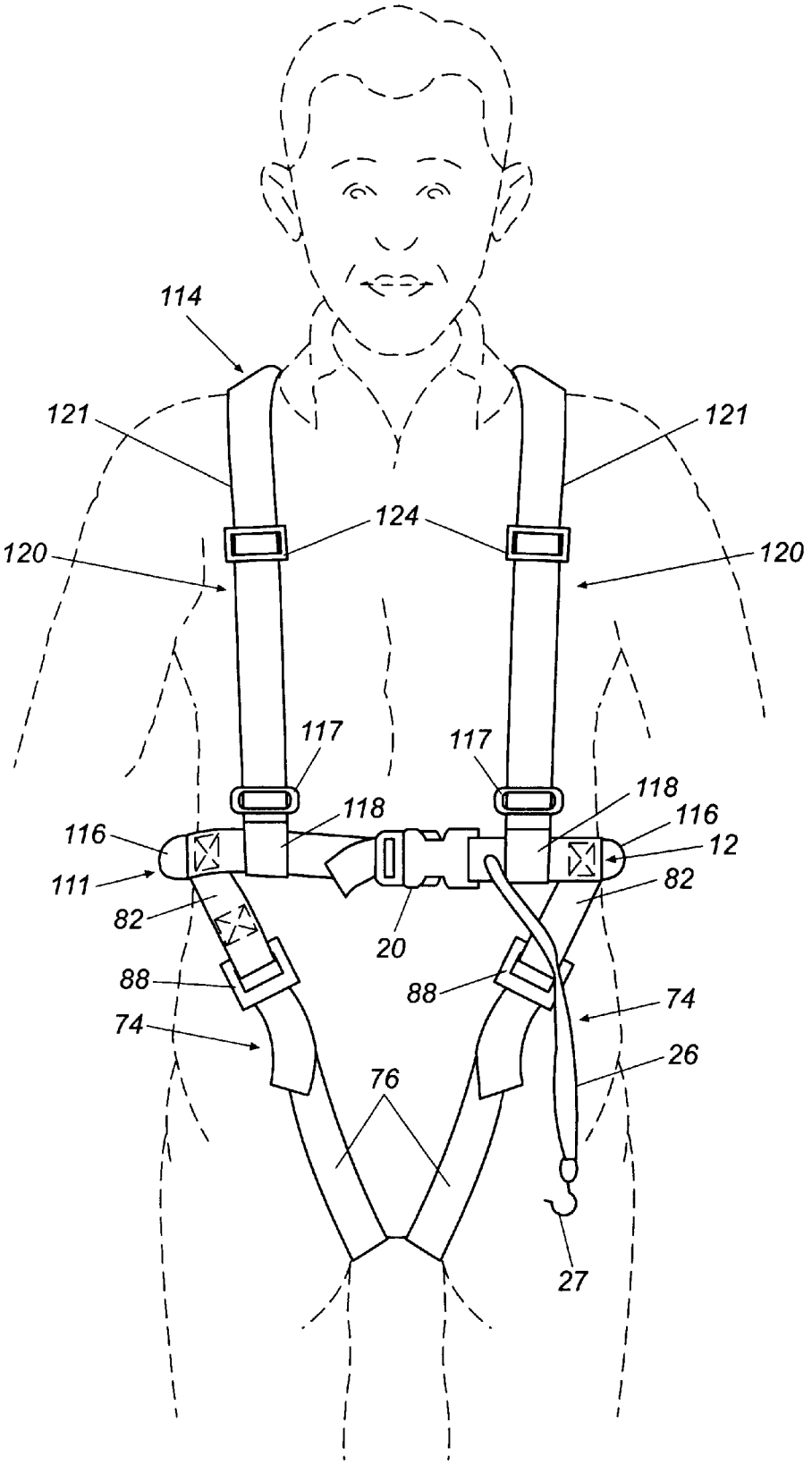
FIG. 9 is a front elevational view of a second embodiment of the safety harness assembly of the present invention as worn by a person.
Figure 10:
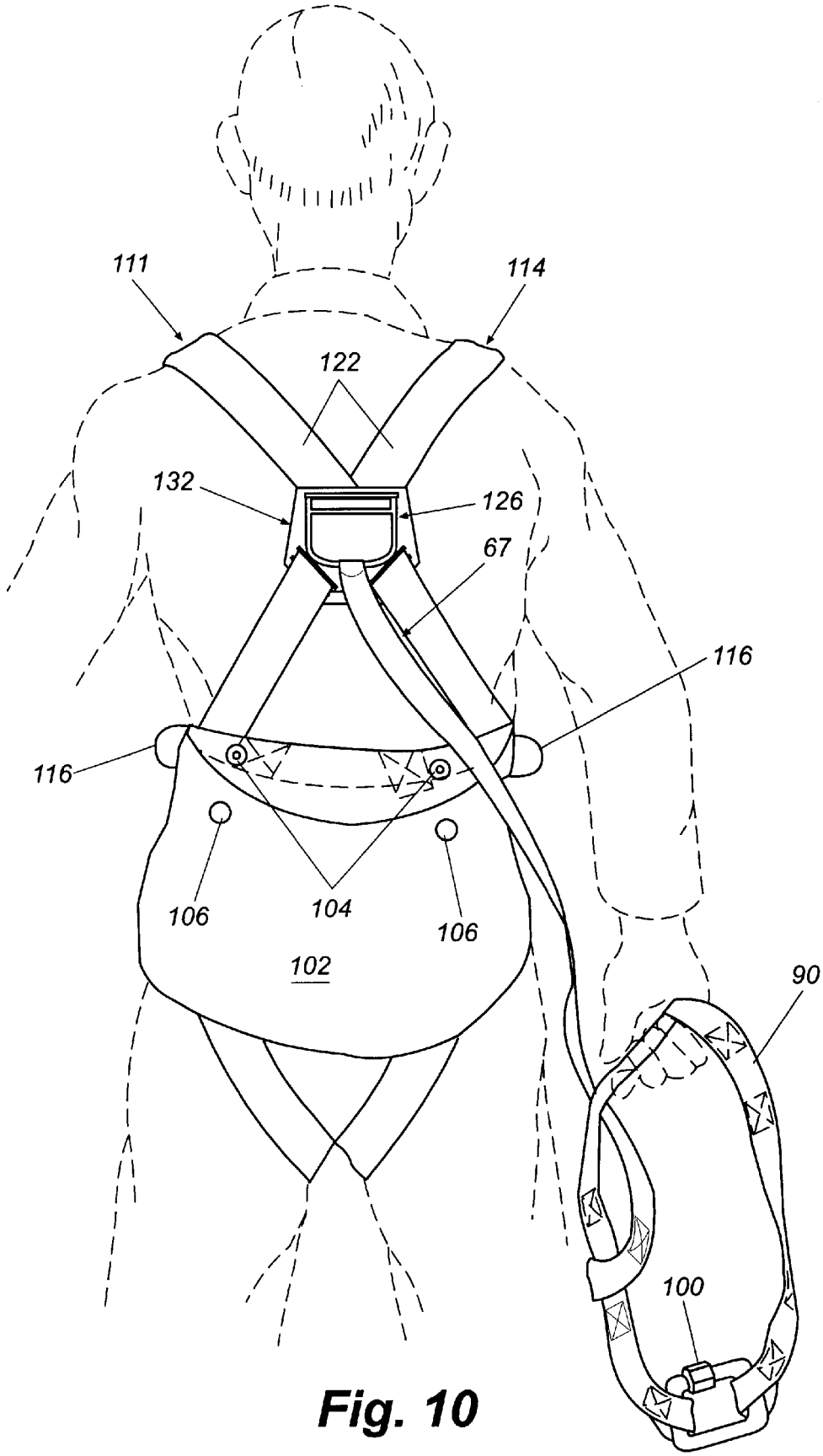
FIG. 10 is a rear elevational view of the second embodiment of the safety harness assembly of the present invention as worn by a person.
Figure 11:
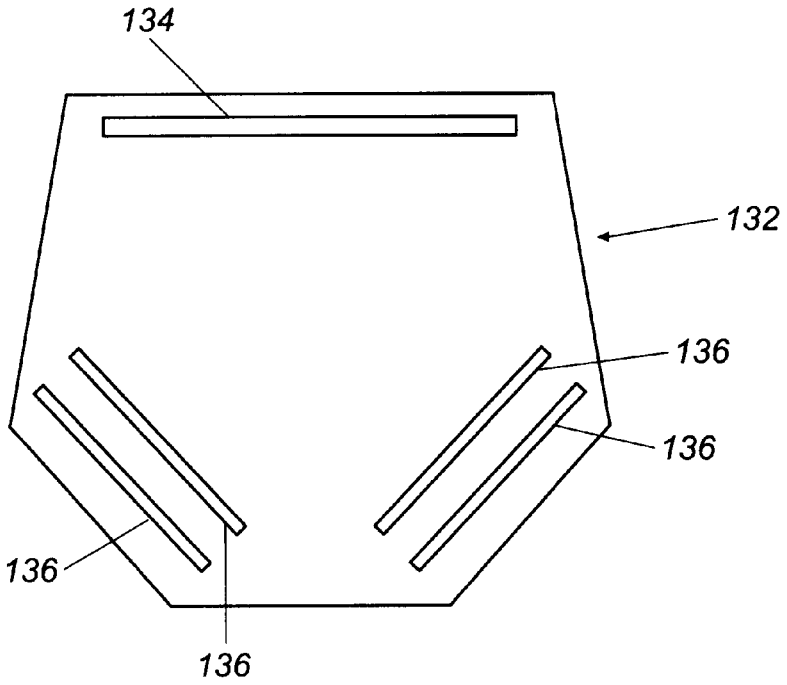
FIG. 11 is an elevational view of the cross strap divider utilized in the second embodiment of the invention as depicted in FIGS. 10 and 11.

FIGS. 9–11 illustrate, by way of example, a second embodiment of the safety harness assembly 111 of the present invention. The safety harness assembly 111 of the second embodiment differs from the harness assembly 10 depicted in FIGS. 1–8 primarily in the configuration or structure of the shoulder harness 28, the elimination of the front cross strap 29, the elimination of the stitching (not numbered) for securing the two rear main, shoulder straps 48, the elimination of the rear cross strap 56, and the addition of a D-ring 126, a cross strap divider 132 and loops or rings 116 (FIGS. 9 and 10) on waist belt 12. In the second embodiment of the invention, several of the reference numerals used with the first embodiment as depicted in FIGS. 1–8 are likewise used to designate the same or similar part.

Referring now to FIGS. 9 and 10, reference numeral 111 designates the second embodiment of the safety harness assembly of the present invention. Safety harness assembly 111 generally comprises a waist belt 12, a shoulder harness 114, thigh straps 74, and a pouch or pocket 102 secured to waist belt 12. The safety restraint device 67 of the second embodiment comprises a lanyard 68, tree strap 90 and connector 100 and is identical to the safety restraint device 67 of the first embodiment. The pouch or pocket 102 is for housing the shoulder harness 114 and possibly the thigh straps 74 of harness assembly 10, and the lanyard 68, tree strap 90 and connector 100 of restraint device 67 when the shoulder harness assembly 111 is not being worn by the user. The waist belt 12 of the shoulder harness assembly 111 can be worn with shoulder harness 114, the lanyard 68, tree strap 90, and possibly the thigh straps 74 stored in the pouch or pocket 102 when shoulder harness assembly 111 and safety restraint device 67 is not used in association with a fixed object such as tree 108.

The waist belt 12 of the shoulder harness assembly 111 in the second embodiment of the invention as depicted in FIGS. 9 and 10 is identical to that of the first embodiment except for the addition of a first pair of loops or rings 116, each fixed to waist belt 12 between its end sections 14 and 18 and its intermediate section 16 and a second pair of loops or rings 117 secured to waist belt 12 by short pieces of webbing 118 and stitching (not shown). The loops or rings 116 secured to the waist belt 12 are for attaching the ends of a conventional climbing belt (not shown) normally used in climbing the tree 108. The loops or rings 116 could be used for other purposes as explained hereinbelow.

Figure 12:
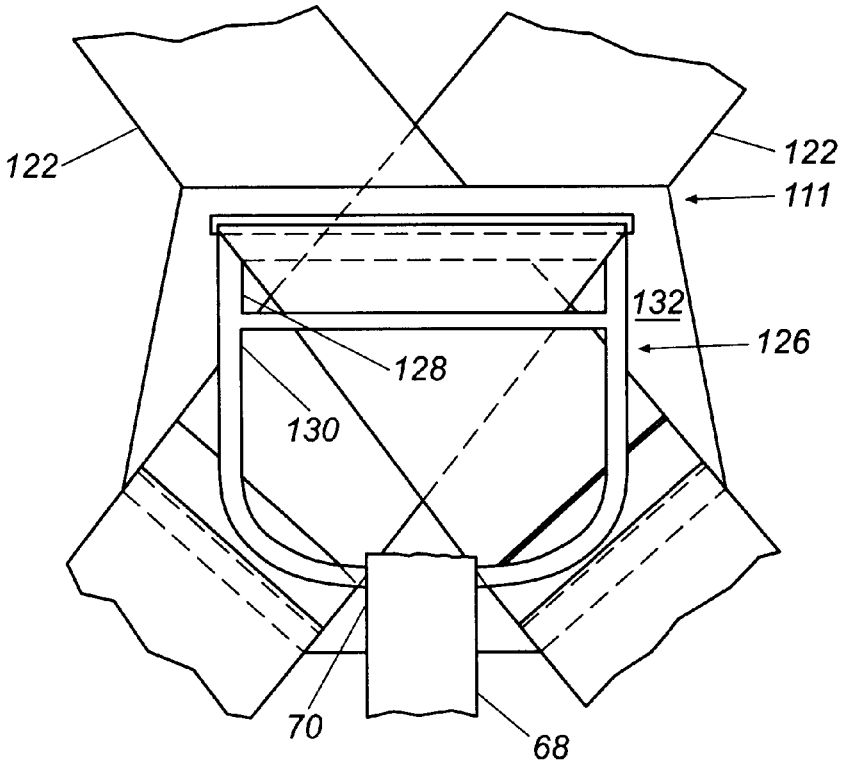
FIG. 12 is a partially broken away, rear elevational, view showing the details of the D-ring and its association with the rear sections of the shoulder harness and the cross strap divider utilized in the second embodiment of the invention as depicted in FIGS. 9 and 10.

Shoulder harness 114 comprises a pair of straps 120, each including a front section 121, and a rear section 122. Each strap 120 has one end (not numbered) in its rear section 122 secured to the intermediate section 16 of waist belt 12 and its other end (not numbered) in its front section 121 passing through a respective loop or ring 117 attached to waist belt 12, and being fixed to a quick release buckle 124 used for loosening and tightening the straps 120 of the shoulder harness 114 about the chest of the user. A quick release buckle 124 is not only fixed to one end of each front section 121 of strap 120, but each buckle 124 has an opening (not numbered) therein which receives a respective front section 121 of a strap 120, thus permitting the buckle 124 to move relative to that portion of front section 121 of strap 120 surrounded by buckle 124 to permit the tightening or loosening of the shoulder harness 114 about the upper body of the person wearing harness assembly 111. Buckles such a quick release buckles 124 are readily available in the commercial market and may be similar to Parts Nos. MS22047-1, 2 or 3 manufactured by United States Forgecraft Corporation, Fort Smith, Ark. As best seen in FIGS. 10 and 12, each rear section 122 of strap 120 of shoulder harness 114 is crossed and surrounded by a D-ring 126 and a cross strap divider 132. As best seen in FIG. 12, D-ring 126 includes a first opening 128 which receives and surrounds portions of the rear sections 122 of straps 120 and a second opening 130 for purposes to be explained later. As best seen in FIG. 11, cross strap divider 132 is a flat plate, preferably made of light metal or plastic, having a first opening 134 and two pairs of second openings 136. As best seen in FIGS. 10 and 12, D-ring 126 passes through the first opening 134 of cross strap divider 132 and a respective rear section 122 of a respective strap 120 passes through a pair of respective second openings 136 of cross strap divider 132. The cross strap divider 132 serves to cross the rear sections 122 of the straps 120 and to hold the rear sections 122 of the straps 120 in place and to hold the D-ring 126 at an appropriate position at the rear of the shoulder harness 114.

The thigh straps 74 of the second embodiment of the invention are identical to those depicted in the first embodiment of the invention. As set forth hereinabove, the lanyard 68 of the second embodiment of the invention is identical to that depicted in the first embodiment of the invention with the first loop 70 of lanyard 68 being secured to D-ring 126 and the second loop 72 receiving tree strap 90. The tree strap 90 of the second embodiment of the invention is identical to that depicted in the first embodiment of the invention and has a releasable connector 100 for closing the tree strap 90.

Shoulder harness assembly 111 still further comprises a pouch or pocket 102 secured to the intermediate section 16 of waist belt 12 by any suitable means such as stitching, cross stitching or rivets, and cooperating male fasteners 104 (FIG. 10) and female fasteners 106 (FIG. 10) for closing pouch or pocket 102. Male and female fasteners 104 and 106 snap together for a friction fit. The male and female fasteners 104 and 106 are readily available in the commercial market and may be similar to fasteners made from selected Parts Nos. X2-10127, X2-10128, XB-10224, XX-10224, BS-10412, BS-10413, BS-10414, and BS-10370 manufactured by United States Textile And Supply Company, with offices at Los Angeles, Calif., Central Falls, R.I., Arlington, Tex. and Fort Lauderdale, Fla.

A bow holder cord 26 is secured at one of its ends to the second end section 18 of waist belt 12 by any suitable means such as cross stitching and has a hook 27 at its free end for holding or supporting a bow, camera or the like, at times when the person perched on a tree stand 110 is not observing wildlife.

The following describes the preferred manner for a person to place the harness assembly 111 of the second embodiment upon his person and to secure safety restraint device 67 to a fixed object such as tree 108 to prevent the person from accidentally falling to the ground and injuring himself:

a. prior to entering the wilderness (woods) the person unbuckles the quick release buckle 20, places the waist belt 12 about his waist, secures the buckle 20 about his waist, and pulls on the free end of waist belt 12 to tighten waist belt 12;

b. the person will then rotate the waist belt 12 until the pouch 102 is in front of the person;

c. the person then removes the shoulder harness 114, the lanyard 68, and the tree strap 90 from pouch 102;

d. the person then rotates waist belt 12 about his waist until buckle 20 is in the front of the person and pouch 102 is in the back of the person;

e. the person then engages the free ends of respective rear thigh straps 76 and threads same through the openings in respective quick release buckles 88 attached to a respective front strap 82 and by pulling on free ends of each rear thigh strap 76 tightens the thigh straps 78 about the thighs of the wearer;

f. the person then pulls on shoulder harness 114 to place shoulder harness 114 about his shoulders (like putting on a jacket);

g. the person then moves buckles 124 along the front sections 121 of straps 120 to tighten shoulder harness 114 about his shoulders;

h. the person then climbs up to stand upon tree stand 110 mounted to tree or fixed object 108 (FIG. 8);

i. the person then threads tree strap 90 through loop 72 of lanyard 68 if such has not been previously accomplished;

j. the person then wraps tree strap 90 about the trunk of tree or other fixed object 108 and engages connector 100 through a selected opening 96 at a location such that tree strap 90 is relatively tight about the trunk of tree or other fixed object 108.

Each of the belt 12, shoulder harness 114, thigh straps 74, lanyard 68 and tree strap 90 can be made of any suitable material including webbings of various sizes made of cotton, nylon, polypropylene, or polyester, which materials, preferable of camouflage colors, are commercially available from Elizabeth Webbing Mills Company, Inc., Pawtucket, R.I. The pouch or pocket 102 is preferably made of a suitable material such as cotton or nylon of a camouflage color.

While the invention herein has been described with particularity, it is to be understood that the invention is not limited to the precise embodiment disclosed herein and that various modifications can be made by one of ordinary skill in the art without departing from the scope and spirit of the invention as defined by the appended claims. For example, the loop 70 of lanyard 68 need not be attached to the rear cross strap 56 of the first embodiment or the D-ring 126 of the second embodiment, but such loop 70 of lanyard 68 could be attached to other parts of the shoulder harness assembly 111. With a connector, such as connector 100, passing through both loop 70 of lanyard 68 and loop or ring 116 fixed to waist belt 12, the lanyard 68 could be connected or secured to waist belt 112 instead of either the cross strap 56 of the first embodiment or the D-ring 126 of the second embodiment. Still for example, the tree strap 90 could be formed of two pieces of webbing, one piece having an opening therein or a loop for receiving a connector, with a conventional quick release buckle connecting the two pieces of webbing.

I claim:

1. A safety harness assembly for maintaining a subject proximate to a vertical object, said device comprising:

a belt adapted to encircle the waist of a wearer, said belt having a first end section, an intermediate section, a second end section, and means for coupling said belt about the waist of the wearer including a quick release buckle having a male member secured to said first end section of said belt and a female member secured to said second end section of said belt;

a shoulder harness including a pair of front main straps, each having a first end portion and a second end portion, a pair of short front straps, a pair of rear main straps, each having a first end portion and a second end portion, means for securing said short front straps to respective said first and second end sections of said belt, means for releasably connecting each said short front strap to a respective said first end portion of said front main strap including a quick release buckle having a pair of openings therein through which passes said first end portion of a respective said front main strap, a rear cross strap having a pair of end portions, means including a pair of O-rings for connecting each said second end portion of said front main strap to a respective said first end portion of said rear main strap and to a respective said end portion of said rear cross strap, means for securing said second end portions of said rear main strap to said intermediate section of said belt, a lanyard having first and second end sections, said first end section of said lanyard being connected to said means for connecting each said second end portion of said front main straps to said first end portion of said rear main straps and said rear cross strap;

a pair of first thigh straps having first and second end portions, each said first end portion being secured to said intermediate section of said belt, each said second end portion having a free end;

a pair of second thigh straps, each having first and second end portions, each said first end portion being secured to a respective first and second end section of said belt, each said second end portion having a quick release buckle secured thereto, with each buckle having a pair of openings therein through which said free end of said second end portion of a respective said first thigh strap passes to secure each said thigh strap about the thighs of the subject;

a strap for engagement with said second end section of said lanyard and with said vertical object, said strap including a series of spaced openings and a releasable connector for passing through two of said spaced openings whereby said strap may be secured around said vertical object; and a pouch secured to said intermediate section of said belt for housing said shoulder harness and said vertical object engaging strap to reduce the possibility of entanglement of said shoulder harness and said vertical object engaging strap when said safety restraint device is not being worn by the subject.

2. The safety restraint device of claim 1 wherein said pouch includes means for closing said pouch when housing said shoulder harness and said vertical object engaging strap.

3. The safety restraint device of claim 2 wherein said means for closing said pouch includes a plurality of male and female fasteners.

4. The safety restraint device of claim 3 including a short strap having a first end portion secured to said belt and a second end section having a hook secured thereto.

5. A safety harness assembly for maintaining a subject proximate to a vertical object comprising:

a waist belt adapted to encircle the subject's waist, said waist belt including an intermediate section and a quick release buckle;

shoulder harness means adapted for surrounding the subject's chest and shoulders, said shoulder harness means including front and rear members and a quick release buckle within each said front member;

means connecting said rear members to a respective said front member of said shoulder harness means;

a rear cross strap secured to said means connecting said rear and said front members of said shoulder harness means;

web means secured to said waist belt adapted for engaging and surrounding the subject's thighs and including quick release buckles therein;

lanyard means including a first end section and a second end section, said first end section being engaged with said rear cross strap;

a strap for engagement with said second end section of said lanyard means and with said vertical object; and a pouch secured to said intermediate section of said waist belt for housing said shoulder harness means, said means for connecting said rear and front members of said shoulder harness means, said rear cross strap, said lanyard means, and said vertical object engaging strap to reduce the possibility of entanglement thereof when said safety restraint device is not being worn by the subject.

6. The safety harness assembly of claim 5 wherein said pouch includes means for closing said pouch when housing said shoulder harness and said vertical object engaging strap.

7. The safety harness assembly of claim 6 wherein said means for closing said pouch includes a plurality of male and female fasteners.

8. The safety harness assembly of claim 7 wherein said quick release buckle within said waist belt includes a female member and a male member.

9. The safety harness assembly of claim 8 wherein said shoulder harness means further includes an adjustable front cross strap connecting said front members, said front cross strap including a quick release buckle having a hollow female member and a male member.

10. The safety harness assembly of claim 9 wherein said means for connecting said rear members to a respective said front member of said shoulder harness includes a pair of O-rings.

11. The safety restraint device of claim 10 wherein said first end section of said lanyard means is slidably engaged with said rear cross strap.

12. The safety harness assembly of claim 11 wherein said strap for engagement with said second end section of said lanyard means and said vertical object includes a series of spaced openings and a releasable connector for passing through two of said spaced openings whereby said strap may be secured around said vertical object.

13. The safety harness assembly of claim 12 including a short strap having a first end portion secured to said waist belt and a second end portion having a hook secured thereto.

* * * * *